US006705940B1

(12) United States Patent
Moore

(10) Patent No.: US 6,705,940 B1
(45) Date of Patent: Mar. 16, 2004

(54) PORTABLE DOORWAY BUG DEFLECTOR

(76) Inventor: Gary L. Moore, 400 American River Dr., Lake Cormorant, MS (US) 38641

( * ) Notice: Subject to any disclaimer, the term of this patent is extended or adjusted under 35 U.S.C. 154(b) by 0 days.

(21) Appl. No.: 10/269,625

(22) Filed: Oct. 15, 2002

(51) Int. Cl.[7] ..... F24F 9/00
(52) U.S. Cl. ..... 454/188
(58) Field of Search ..... 454/188, 190, 454/191, 192

(56) References Cited

U.S. PATENT DOCUMENTS

| | | | | | |
|---|---|---|---|---|---|
| 1,095,499 | A | * | 5/1914 | Gillespie | 454/188 |
| 3,817,160 | A | * | 6/1974 | Searcy et al. | 454/188 |
| 4,179,839 | A | | 12/1979 | Salotti et al. | |
| 4,359,081 | A | | 11/1982 | Brower | |
| 4,673,019 | A | | 6/1987 | Silverthorne et al. | |
| 4,988,847 | A | * | 1/1991 | Argos et al. | 392/363 |
| 5,369,909 | A | | 12/1994 | Murphy | |
| 5,412,904 | A | | 5/1995 | Hansbrough | |
| 5,450,889 | A | | 9/1995 | Jones et al. | |
| 5,988,256 | A | | 11/1999 | Winters | |
| 6,234,892 | B1 | | 5/2001 | Geyer et al. | |
| 6,450,879 | B1 | * | 9/2002 | Suen | 454/188 |
| 6,470,698 | B2 | * | 10/2002 | Nishi et al. | 62/239 |

FOREIGN PATENT DOCUMENTS

| | | | | |
|---|---|---|---|---|
| EP | 231-963 A | * | 8/1987 | 454/188 |

* cited by examiner

*Primary Examiner*—Harold Joyce
(74) *Attorney, Agent, or Firm*—Donald R. Schoonover

(57) ABSTRACT

Insects, debris and the like are prevented from moving into a building via an open door by a fan unit that is mounted on the side of the doorway to extend for the entire length of the door and to direct air outwardly with respect to the building at an oblique angle with respect to a plane containing the doorway. The fan is activated when the door is opened and de-activated when the door is closed.

5 Claims, 3 Drawing Sheets

PORTABLE DOORWAY BUG DEFLECTOR

BACKGROUND OF THE INVENTION

1. Field of the Invention

The present invention relates to the general art of static structures, and to the particular field of protecting openings through walls of static structures.

2. Discussion of the Related Art

Many people like to leave the doors of their homes open especially during mild weather. However, when a door is open, insects and debris often migrate through the open doorway and into the interior of the home. This is an unacceptable situation, especially in view of the many diseases that insects have been known to carry. Still further, even if a door is closed, if it is opened even briefly to allow someone to pass into or out of a building, that opening, no matter how brief, tends to permit insects and debris to migrate into the interior of the building. In some instances, due to temperature differences between the interior of the building and the exterior of the building, there actually is a pressure difference which tends to draw such unwanted items into the interior of the building. Thus, even if a building has a screen door or a storm door, opening that door may expose the interior of the building to invasion of insects or debris or other such unwanted elements.

Therefore, there is need for a system that will prevent movement of insects, debris or other such elements into the interior of a building through an open doorway. Still further, there is a need for such a system that will operate to protect the interior of a building even if a door is opened only very briefly.

While the art contains disclosures of air curtains used in association with loading dock doors and the like, these air curtains do not adequately prevent migration of insects and debris through an open doorway especially if that doorway is only very briefly opened, or only slightly opened.

It may be wasteful to operate an air curtain on a continuous basis; however, in a loading dock situation, such continuous operation may be acceptable since the access opening may be in nearly continuous use. However, such a situation usually does not exist for a homeowner.

Therefore, there is a need for a system that will prevent movement of insects, debris and the like through a doorway and is activated only when the doorway is open and is inactive at all other times.

However, to be fully effective, such a system should be activated as soon as the doorway is open enough for such unwanted elements to move through the doorway.

Therefore, there is a need for a system that will prevent movement of insects, debris and the like through a doorway and that will be active only when the door is open and will be inactive when the door is closed, but will be activated as soon as the door is open enough to permit unwanted elements to move through the doorway.

As is well known, if there is any possible path into a building, insects will find such a path. Therefore, in order to be fully effective, any system which is intended to prevent migration of insects, debris or the like into the interior of a building via an open door must protect essentially the entire doorway.

Therefore, there is a need for a system that will prevent the migration of insects, debris or the like into the interior of a building through an open door and which protects essentially the entire area of the doorway, from the bottom to the top and from one side of the doorway to the other side of the doorway.

PRINCIPAL OBJECTS OF THE INVENTION

It is a main object of the present invention to provide a system for preventing unwanted elements, such as insects, debris or the like, from moving into a building through an open door.

It is another object of the present invention to provide a system for forming a protective air layer across an access doorway of a building It is another object of the present invention to provide a system for preventing unwanted elements, such as insects, debris or the like, from moving into a building through an open door and which will be activated as soon as the door is opened and will be inactive at other times.

It is another object of the present invention to provide a system for preventing unwanted elements, such as insects, debris or the like, from moving into a building through an open door and which is oriented to provide a stream of air flowing in an outward direction with respect to the building interior.

It is another object of the present invention to provide a system for preventing unwanted elements, such as insects, debris or the like, from moving into a building through an open door and which is oriented to provide a stream of air flowing in an outward direction with respect to the building interior and in which the air flows at an oblique angle with respect to a plane containing the doorway.

It is another object of the present invention to provide a system for preventing unwanted elements, such as insects, debris or the like, from moving into a building through an open door and which is oriented to provide a stream of air flowing in an outward direction with respect to the building interior and which protects essentially the entire length dimension of the doorway.

SUMMARY OF THE INVENTION

These, and other, objects are achieved by a system for forming a protective air layer across an access doorway of a building comprising a wall of a building, the wall having an interior side inside the building and an exterior side and extending upwardly from a ground level; a doorway defined through the wall, said doorway having a length dimension and a width dimension, with the length dimension extending upwardly from the ground level, the doorway being contained in a plane; a jamb on the wall around the doorway; a door moveably mounted on the jamb to move between a closed position and an open position; a fan unit mounted on the jamb adjacent to the doorway, the fan unit including a motor unit mounted on the jamb adjacent to the doorway, two fan housings mounted on the jamb adjacent to the doorway and extending upwardly from the ground level, each fan housing including an intake side, a plurality of vents, each vent of the plurality of vents being oriented at an oblique angle with respect to the plane containing the doorway and directed away from the interior side of the wall, a rotor mounted inside each fan housing, and a plurality of arcuate rotor blades mounted on the rotor of each housing and oriented to draw air from the intake side of the housing associated therewith and move the air to the vents of the plurality of vents of the housing associated therewith; and a circuit which includes a switch mounted on the jamb to be held in an open position when the door is in the closed position and to move into a closed position when the door is moved into the open position, a power source electrically connected to the switch to be connected to the motor when the switch is in the closed position, the motor being activated and rotating the rotor blades when connected to the power source; the fan unit extending for essentially the entire length dimension of the doorway. Air flowing out of the vents of the plurality of vents moves at an oblique angle across the doorway with respect to the plane containing the doorway, with the plane containing the doorway being located between the air flowing out of the vents and the plane containing the doorway and between the exterior side of the wall and the interior side of the wall.

Thus, every time the door is opened, a curtain of air is set up across the doorway and is directed outwardly of the building. Any debris or insects will thus be blown outwardly with respect to the building each time the door is opened. This will protect the building against such unwanted intruders. Even if the door is only slightly cracked open, the curtain of air will be set up and the doorway will thus be protected. The air is directed at an oblique angle with respect to the plane containing the doorway and thus will blow outwardly with respect to the building thereby not only protecting the doorway but also tending to clean out the area adjacent to the doorway. Since the fan housings extend for the entire length dimension of the doorway, the air flowing out of the vents will cover the entire area of the doorway and thus will protect the entire area of the doorway.

BRIEF DESCRIPTION OF THE DRAWING FIGURES

DETAILED DESCRIPTION OF THE PREFERRED EMBODIMENT

Figure 2:
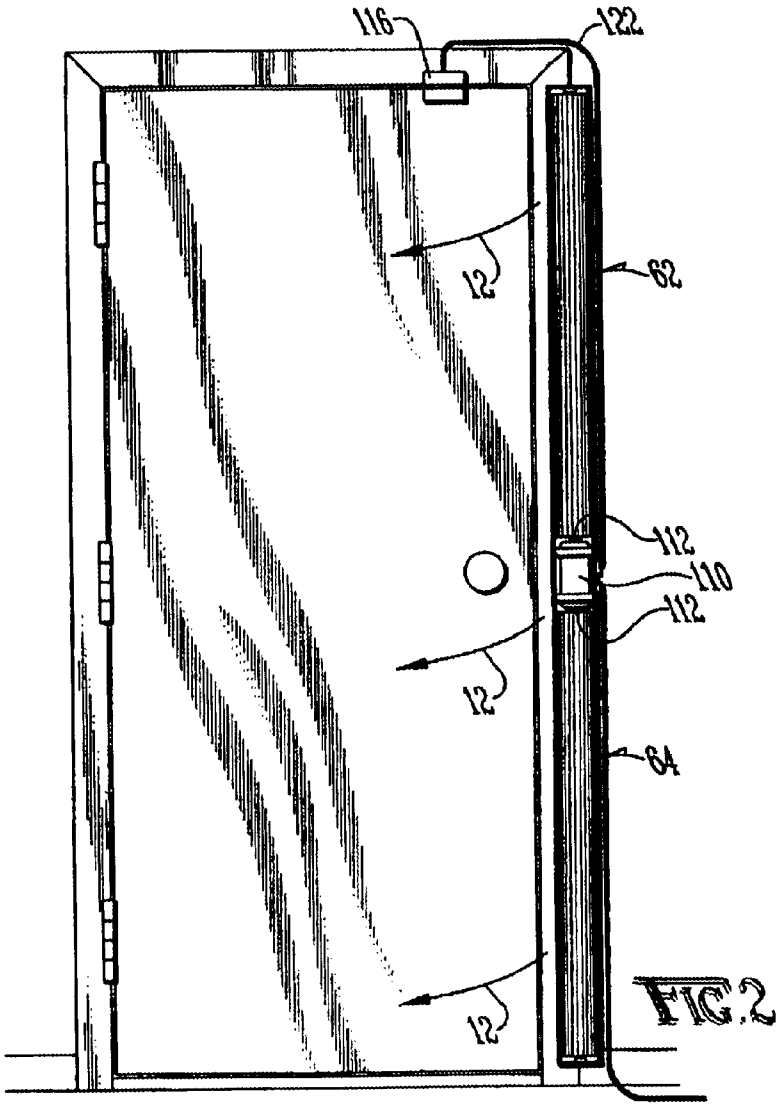
FIG. 2 shows the fan housings of the present invention in place adjacent to the doorway.

Other objects, features and advantages of the invention will become apparent from a consideration of the following detailed description and the accompanying drawings.

As shown in the figures, the present invention is embodied in a system 10 for forming a protective air layer 12 across an access doorway 14 of a building 16.

A wall 18 of building 16 has an interior side 20 inside the building and an exterior side 22 outside the building 16. A doorway 24 is defined through the wall 18 and traffic passes through the doorway 24 into and out of the building 16. A jamb 26 is located on the wall 18 around the doorway 24. Jamb 26 includes a first side 28, a second side 30, and a width dimension 32 measured between the first side 28 and the second side 30 of the jamb 26. Jamb 26 further includes a first end 34, a second end 36, and a length dimension 38 measured between the first end 34 and the second end 36 of the jamb 26.

Hinges, such as hinge 40, are mounted on the first side 28 of the jamb 26. A door 42 is mounted in the doorway 24 on the hinges 40. Door 42 includes a first side 44 adjacent to the first side 28 of the jamb 26, a second side 46, and a width dimension 48 extending between the first side 44 of the door 42 and the second side 46 of the door 42. Door 42 further includes a first end 50 adjacent to the first side 28 of the jamb 26, a second end 52 adjacent to the second end 36 of the jamb 26, and a length dimension 54 extending between the first end 50 of the door 42 and the second end 52 of the door 42.

Figure 1:
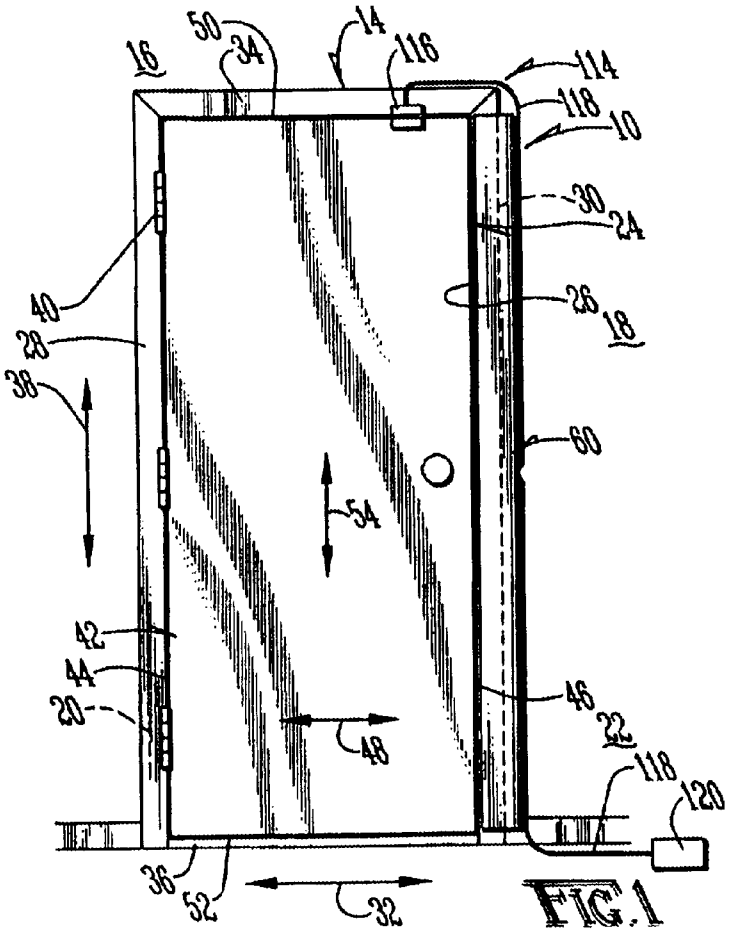
FIG. 1 shows a door and doorway which includes the system embodying the present invention.

The door 42 is movable between a closed condition as shown in FIG. 1 extending over the opening 24 in the wall 18 and having the second side 46 of the door 42 adjacent to the second side 30 of the jamb 26 and an open condition having the second side 30 of the door 42 spaced apart from the second side 30 of the jamb 26. For the purposes of this disclosure, the door 42 is considered as being in the open position when the second side 46 of the door 42 is spaced apart from the second side 30 of the jamb 26 by as small as ¾ inch.

A fan unit 60 is mounted on the second side 30 of the jamb 26. The fan unit 60 includes two fan housings 62 and 64. The fan housings 62, 64 are identical to each other. Each fan housing 62, 64 includes a first end 66, a second end 68, and a length dimension 70 extending between the first end 66 of each fan housing 62, 64 and the second end 68 of each fan housing 62, 64. The length dimensions 70 of the fan housings 62, 64 are aligned with each other and with the length dimension 38 of the door jamb 26. Each fan housing 62, 64 includes a first side 72 which extends between the first end 66 of the fan housing 62, 64 and the second end 68 of the fan housing 62, 64. The first side 72 of each fan housing 62, 64 is fixed to the wall 18 adjacent to the second side 30 of the jamb 26. A second side 74 of the fan housing 62, 64 extends between the first end 66 of the fan housing 62, 64 and the second end 68 of the fan housing 62, 64. The second side 74 of the fan housing 62, 64 is spaced apart from the first side 72 of the fan housing 62, 64. An offset portion 78 of the second side 74 of the fan housing 62, 64 is offset from a remaining portion 80 of the second side 74 of the fan housing 62, 64 and is oriented at an oblique angle $\theta$ to the remaining portion 80 of the second side 74 of the fan housing 62, 64.

Two side panels 82 and 84 connect the offset portion 78 of the second side 74 of the fan housing 62, 64 to the remainder of the second side 74 of the fan housing 62, 64.

A plurality of air vents, such as air vent 90, are defined through the offset portion 78 of the second side 74 of the fan housing 62, 64. The air vents 90 are spaced apart from each other along the length dimension 70 of the fan housing 62, 64. The air vents 90 are all oriented at oblique angle 0 with respect to the wall 18. The air vents 90 are located adjacent to the exterior side 22 of the wall 18 with the wall 18 being located between the air vents 90 and the interior side 22 of the wall 18. The air vents 90 are also located adjacent to the second side 30 of the jamb 26 to establish a flow of air across the door opening 24. Being located adjacent to the second side 30 of the jamb 26 and having the fan housings 62, 64 extending for essentially the entire length 38 of the jamb 26 permits the system 10 to establish a wall of air across any opening that is defined in the doorway 24 as soon as the door 42 is opened. Thus, even if the door 42 is only slightly cracked open, the wall of air established by the air vents 90 will protect that opening 24 as soon as the door 42 is moved even slightly away from the jamb 26. Thus, one source of entry into the building 16 by insects, debris or the like is immediately sealed off as soon as the door 42 is opened. The air flow direction is also outwardly of the opening 24 so any insects or debris that may be in the air adjacent to the door 42 when the door 42 is closed will be blown away from the doorway 24 as soon as the door 42 is opened. This actually clears the area adjacent to the doorway 24 in addition to simply preventing the unwanted elements from entering the building 16 via the doorway 24.

An air intake 92 is located on the remaining portion 80 of the second side 74 of the fan housing 62, 64. The air intake 92 is located and oriented to be in fluid communication with the air located inside the building 16. Thus, when the system 10 of the present invention is activated, inside air is blown out and across any opening established in the doorway 24 as soon as that opening is established. If there is any temperature gradient or the like that may create a pressure gradient that tends to draw air from outside the building 16 into the building 16, such air flow is opposed by the air wall established from the air vents 90 of the system 10 of the present invention.

Figure 4:
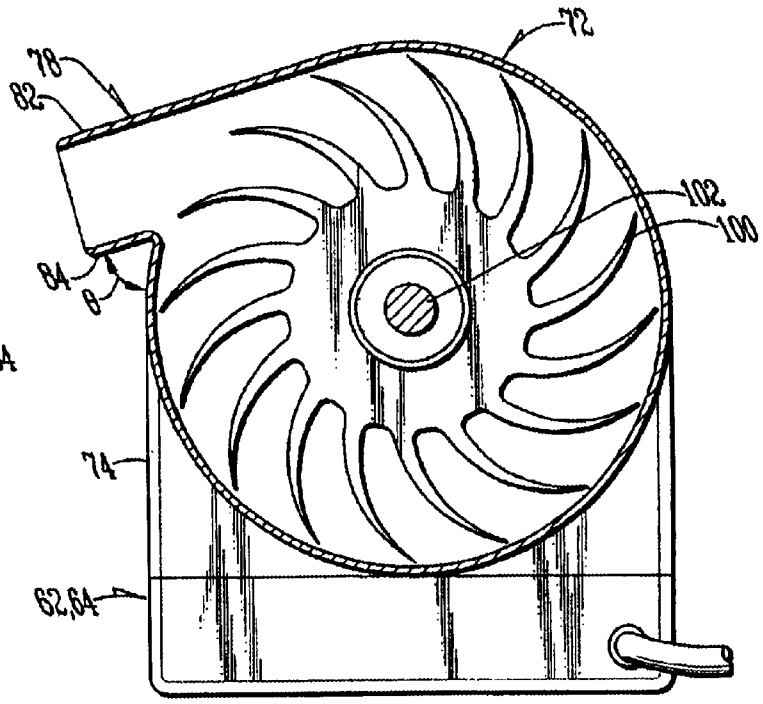
FIG. 4 is a top plan view of a fan housing of the fan unit included in the system embodying the present invention along with a top plan view of a plurality of arcuate rotor blades included in the fan unit included in the system embodying the present invention.
Figure 3:
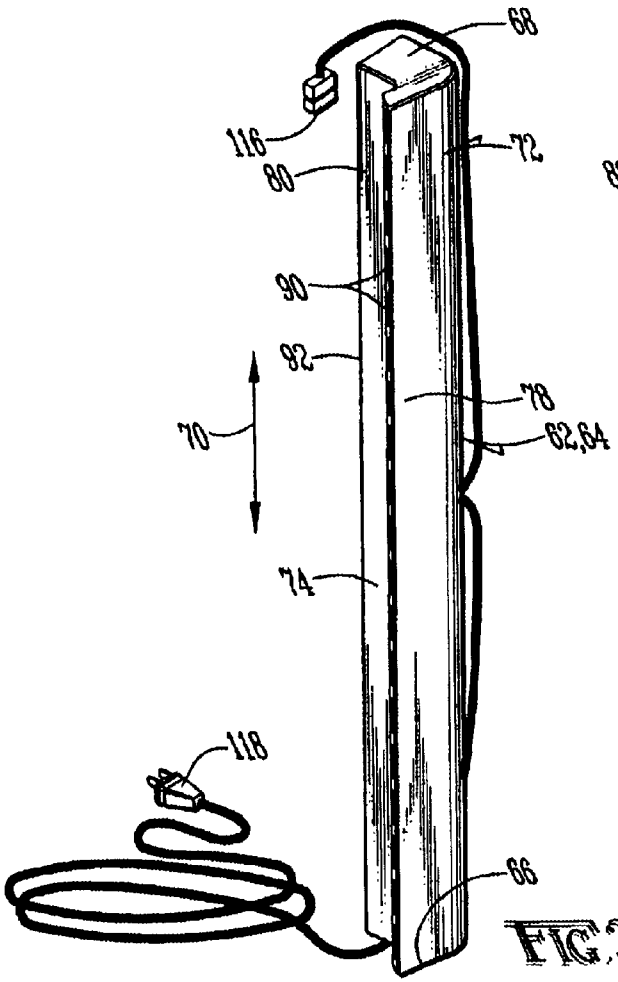
FIG. 3 is a perspective view of a fan housing and some circuitry associated therewith.
Figure 5:
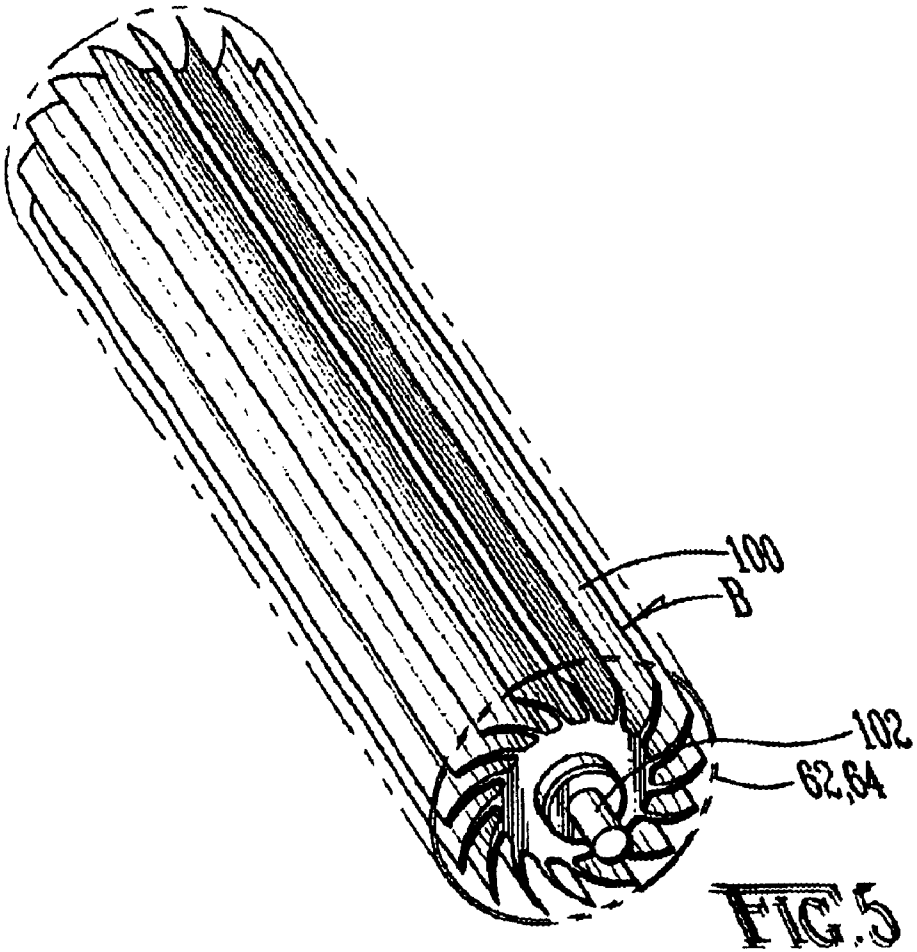
FIG. 5 is a perspective view of a rotor unit included in the fan unit of the present invention.

A plurality of arcuate rotor blades, such as blade 100, are located in each housing 62, 64 of the fan unit 60. The rotor blades 100 are mounted on a rotor shaft 102 and are located between the intake 92 of the housing 62, 64 and the air vents 90 of the housing 62, 64 and are shaped as indicated in FIGS. 4 and 5 to move air from the intake 92 of the housing 62, 64 to the vents 90 of the housing 62, 64. The rotor blades 100 extend along the length dimension 38 of the jamb 26.

The two housings 62, 64 of the fan unit 60 are oriented with respect to each other so the length dimension 70 of one housing 62 or 64 is aligned with the length dimension 70 of the other housing 64 or 62.

Air moving out of the air vents 90 flows at an oblique angle with respect to a plane containing the doorway 24 and moves across the doorway 24 so the doorway 24 is interposed between the air moving out of the air vents 90 and the interior side 20 of the wall 18.

A motor 110 is mounted on the wall 18 between the two housings 62, 64. The motor 110 includes an output shaft 112 connected to the rotor shaft 102 of each housing 62, 64 to rotate the rotor blades 100 in each housing 62, 64 when the motor 110 is activated. Motor 110 is a 1500 rpm motor in one form of the invention.

A control circuit 114 includes a switch 116 which can be a proximity switch such as shown in FIG. 2, or a normally closed switch that is held open by the door 42 when closed, or the like. The switch 116 is mounted on the door jamb 26 to be contacted by the second side 46 of the door 42 when the door 42 is in the closed condition in order to open the switch 116. If a proximity switch is used, the proximity of the second side 46 of the door 42 to the switch 116 will be used to open the switch 116. A power cord 118 connects the switch 116 to a power source 120. An electric cord 122 connects the switch 116 to the motor 110. The switch 116 is movable between an OFF condition and an ON condition. Power from the power source 120 is applied to the motor 110 when the switch 116 is in the ON position.

The combined length dimensions 70 of the two housings 62, 64 of the fan unit 60 and a length dimension of the motor 110 of the fan unit 60 is essentially equal to the length 38 of the doorway 24. In this manner, the entire area of the doorway 24 is covered by the air flowing out of the air vents 90 to force insects, debris and the like away from the doorway 24 every time the door 42 is opened. The oblique angle directs the air flow to achieve this result and the fan housings 62, 64 extending for the entire length of the door protects the entire door area.

It is understood that while certain forms of the present invention have been illustrated and described herein, it is not to be limited to the specific forms or arrangements of parts described and shown.

What is claimed and desired to be covered by Letters Patent is:

1. A system for forming a protective air layer across an access doorway of a building comprising:

a) a wall of a building, the wall having an interior side inside the building and an exterior side;

b) a doorway defined through said wall;

c) a jamb on said wall around said doorway, said jamb including
  (1) a first side,
  (2) a second side,
  (3) a width dimension measured between the first side and the second side of the jamb,
  (4) a first end,
  (5) a second end, and
  (6) a length dimension measured between the first end and the second end of the jamb;

d) a hinge on the first side of said jamb;

e) a door, having
  (1) a first side adjacent to the first side of said jamb,
  (2) a second side,
  (3) a width dimension extending between the first side of said door and the second side of said door,
  (4) a first end adjacent to the first end of said jamb;
  (5) a second end adjacent to the second end of said jamb, and
  (6) a length dimension extending between the first end of said door and the second end of said door;

f) said hinge connecting the first side of said door to the first side of said jamb;

g) said door being movable between a closed condition extending over the opening in said wall and having the second side of said door adjacent to the second side of said jamb and an open condition having the second side of said door spaced apart from the second side of said jamb;

h) a fan unit on the second side of said jamb, said fan unit including
  (1) two fan housings, each fan housing including
    (A) a first end,
    (B) a second end,
    (C) a length dimension extending between the first end of each fan housing and the second end of each fan housing, the length dimensions of each fan housing being aligned with the length dimension of the door jamb,
    (D) a first side which extends between the first end of the fan housing associated therewith and the second end of the fan housing associated therewith, the first side of each fan housing being fixed to said wall adjacent to the second side of said wall,
    (E) a second side which extends between the first end of the fan housing associated therewith and the second end of the fan housing associated therewith, the second side of each fan housing being spaced apart from the first side of each fan housing,
    (F) an offset portion of the second side of each fan housing being offset from a remaining portion of the second side of each fan housing and oriented at an oblique angle to the remaining portion of the second side of each fan housing,
    (G) two side panels connecting the offset portion of the second side of each fan housing to the remainder of the second side of each fan housing, (H) a plurality of air vents defined through the offset portion of the second side of each fan housing, the air vents of the plurality of air vents being spaced apart from each other along the length dimension of the fan housing associated therewith, the air vents all being oriented at an oblique angle with respect to the wall, the air vents being located adjacent to the second side of said jamb and on the exterior side of said wall with said wall being located between said air vents and the interior side of said wall, the vents of the plurality of vents being located adjacent to the second side of the door when the door is in the closed condition, (I) an air intake on the remaining portion of the second side of each fan housing, the intake being located and oriented to fluidically contact air located on the inside the building, and (J) a plurality of arcuate rotor blades located in each housing of said fan unit, the rotor blades being mounted on a rotor shaft and being located between the intake of the housing associated therewith and the air vents of the housing associated therewith and being shaped to move air from the intake of the housing associated therewith to the vents of the housing associated therewith, the rotor blades extending along the length dimension of said jamb, (2) the two housings of said fan unit being oriented with respect to each other so the length dimension of one housing is aligned with the length dimension of the other housing, (3) air moving out of the air vents moving at an oblique angle with respect to a plane containing the doorway and moving across the doorway so the doorway is interposed between the air moving out of the air vents and the interior side of said wall, (4) a motor mounted on said wall between the two housings of said fan unit, the motor including an output shaft connected to the rotor shaft in each housing to rotate the rotor blades in each housing when the motor is activated, (5) a control circuit which includes (A) a switch mounted on said door jamb to be adjacent to the second side of said door when said door is in the closed condition to place the switch in an off condition, (B) a power cord connecting the switch to a power source, and (C) an electric cord connecting the switch to the motor, and (6) the switch being movable between the OFF condition and an ON condition, with power from the power source being applied to the motor when the switch is in the ON condition; and i) the combined length dimensions of the two housings of said fan unit and a length dimension of the motor of said fan unit being essentially equal to the length of said doorway.

2. The system as described in claim 1 wherein the motor operates at least 1500 rpm when activated.

3. The system as described in claim 2 wherein the switch of the control circuit is a proximity switch.

4. The system as described in claim 2 wherein said door is in an open position when the second side of said door is spaced apart from the second side of said wall by a distance of more than ¾ inch.

5. A system for forming a protective air layer across an access doorway of a building comprising:

a) a wall of a building, the wall having an interior side inside the building and an exterior side and extending upwardly from a ground level;

b) a doorway defined through said wall, said doorway having a length dimension and a width dimension, with the length dimension extending upwardly from the ground level, said doorway being contained in a plane;

c) a jamb on said wall around said doorway;

d) a door moveably mounted on said jamb to move between a closed position and an open position;

e) a fan unit mounted on said jamb adjacent to said doorway, said fan unit including (1) a motor unit mounted on said jamb adjacent to said doorway, (2) two fan housings mounted on said jamb adjacent to said doorway and extending upwardly from the ground level, each fan housing including (A) an intake side, (B) a plurality of vents, each vent of said plurality of vents being oriented at an oblique angle with respect to the plane containing said doorway and directed away from the interior side of said wall, (C) a rotor mounted inside each fan housing, and (D) a plurality of arcuate rotor blades mounted on the rotor of each housing and oriented to draw air from the intake side of the housing associated therewith and move the air to the vents of the plurality of vents of the housing associated therewith; and f) a circuit which includes (1) a switch mounted on said jamb to be held in an open position when said door is in the closed position and to move into a closed position when said door is moved into the open position, (2) a power source electrically connected to the switch to be connected to the motor when the switch is in the closed position, the motor being activated and rotating the rotor blades when connected to the power source;

g) said fan unit extending for essentially the entire length dimension of said doorway; and h) air flowing out of the vents of said plurality of vents moving at an oblique angle across said doorway with respect to the plane containing said doorway with the plane containing said doorway being located between the air flowing out of the vents of said plurality of vents and the plane containing said doorway and between the exterior side of said wall and the interior side of said wall with the air flowing out of the vents moving outwardly away from said wall.

* * * * *